US005308940A

United States Patent [19]

O'Brien et al.

[11] Patent Number: 5,308,940

[45] Date of Patent: May 3, 1994

[54] VENTED PRESSURE SWITCH APPARATUS

[75] Inventors: Edward F. O'Brien, West Warwick; Gary A. Baker, North Scituate, both of R.I.

[73] Assignee: Texas Instruments Incorporated, Dallas, Tex.

[21] Appl. No.: 73,924

[22] Filed: Jun. 8, 1993

[51] Int. Cl.[5] ..... H01H 35/34

[52] U.S. Cl. ..... 200/83 P; 73/723; 200/302.1; 200/306

[58] Field of Search ..... 92/5 R, 103 M; 307/118; 340/626; 73/717, 723, 861.47; 200/81 R, 81.4, 83 A, 83 R, 83 N, 83 P, 292, 302.1, 306

[56] References Cited

U.S. PATENT DOCUMENTS 3,835,271 9/1974 Garrett ..... 200/834
4,006,083 2/1977 Westervelt ..... 210/90
4,853,503 8/1989 Sanford .
4,861,953 8/1989 Sanford .
5,004,876 4/1991 Sogge et al. .
5,015,808 5/1991 Czarn et al. .
5,049,708 9/1991 Baker ..... 200/83 P
5,101,549 4/1992 Sogge et al. .

*Primary Examiner*—Gerald P. Tolin
*Attorney, Agent, or Firm*—Russell E. Baumann; Richard L. Donaldson; René E. Grossman

[57] ABSTRACT

A switch having first and second housing members 12, 14 sandwiching a combination terminal and disc seat member 30 has a tortuous vent path 64, 66 and 68 formed through first and second, annular bearing surfaces 60, 62 in the top surface of the second housing member. The terminal and disc seat member 30 and top surface 42 of the second housing member are configured such that an interference fit is formed between the terminal and the disc seat member 30 and the second, annular bearing surface 62.

9 Claims, 3 Drawing Sheets

VENTED PRESSURE SWITCH APPARATUS

BACKGROUND OF THE INVENTION

This invention relates generally to pressure switches and more specifically to vented pressure switches adapted for use with hydraulic fluid control lines of a motor vehicle automatic transmission system.

In recent years, it has become conventional in the motor vehicle art to control various engine and power-train functions by means of microprocessor based controls to obtain optimum performance. For example, actuation of valves used to effect transmission gear shifting and valve actuation are sensed by placing normally open and normally closed pressure responsive electrical switches in communication with hydraulic lines so that a change in pressure in such lines which occurs upon valve actuation and de-actuation can be sensed and a suitable electrical signal provided to the microprocessor as a result of the switching. Switch assemblies of this type are shown for example in U.S. Pat. Nos. 4,861,953; 4,853,503; 5,004,876; 5,015,808 and 5,101,549, all assigned to the assignee of the present invention.

The above referenced switches employ a pressure responsive member placed in pressure communication with hydraulic fluid in a control valve line. Upon a selected change in pressure of the fluid the pressure responsive member experiences a change from one configuration to another configuration and in so doing either closes or opens an electrical circuit which is adapted to provide a signal to the microprocessor of the particular change in pressure signifying the switching of a valve and a corresponding change in a transmission function. In order for the switching to be an accurate reflection of the change in pressure it is important that the switches have a consistent response time even with changing temperatures, actuation/release pressures, endurance life and so on. This in turn requires a hermetic enclosure for the switch contact system or a means for venting of the switch contact system if the contact system operates immersed in oil (automatic transmission fluid) or a vented switch. Hermetic enclosures, however are prohibitive from a cost standpoint and therefore it is important to provide some means for venting the switching chamber. Another problem which must be dealt with is the environment of the switches. That is, the switches are mounted either totally immersed in fluid or in areas where they are splashed with fluids on a regular basis. These fluids contain contaminants such as chips or slivers from the transmission gears which are carried by the hydraulic fluid. These contaminants can have an adverse affect on switch operation. Normally open switches are particularly sensitive to contamination with large particles or slivers sometimes bridging the gap between the movable contact member when in the normal open position and the stationary contact thereby giving a false actuation signal to the microprocessor.

It is an object of invention to provide an inexpensive yet reliable pressure responsive electrical switch having improved insensitivity to contamination present in fluid in the switch environs. Another object of the invention is the provision of an improved vented pressure responsive electrical switch.

SUMMARY OF THE INVENTION

Briefly, in accordance with the invention, a pressure switch apparatus comprises a pressure responsive electrical switch received on a bracket adapted to be attached to the control valve body of a motor vehicle transmission with the pressure responsive switch biased against a port so that it is in pressure communication with an hydraulic fluid control line. The switch comprises first and second housing members sandwiching a combination terminal and disc seat. The first housing has an opening with an O-ring type seal adapted to be received around a port and the second housing mounts a stationary contact in a cavity forming a portion of a switching chamber. The second housing member has a top surface with a first, generally annular bearing surface adjacent the outer periphery thereof lying in a first plane and a second, generally annular bearing surface formed on the top surface adjacent the switching chamber cavity lying in a second plane parallel to the first plane and spaced a selected distance below the first plane. According to a feature of the invention, a vent path to provide controlled flow of fluid into the switching chamber comprises a first channel means formed in the first annular bearing surface from the outer periphery to the inner periphery thereof, a circular groove having a bottom surface disposed below the second plane and in communication with the first channel means and a second channel means in communication with the circular groove formed in the second annular bearing surface from the outer periphery to the inner periphery thereof and in communication with the switching chamber. According to a feature of the invention, the second channel means is angularly offset from the first channel means whereby any particles contained in the fluid flowing into the switching chamber are confined to a tortuous path thereby reducing the quantity and size of particles reaching the switching chamber. According to a feature of the invention, the first channel means comprises a plurality of channels aligned with posts extending from the first housing member into post receiving apertures in the second housing member, the posts serving to obstruct the flow of particles through the first channel means. According to another feature of the invention, the second channel means comprises a plurality of radially extending channels spaced around the second annular bearing surface. The combination terminal and disc seat member and the top surface of the second housing member are configured so that when the housing members are clamped together an interference fit occurs at the second annular bearing surface to ensure that the open area of the second channel means has a cross sectional area no larger than that selected by the design.

Other objects, advantages and details of the novel and improved pressure switch assembly of the invention appear in the following detailed description referring to the drawings.

DESCRIPTION OF THE PREFERRED EMBODIMENTS

Figure 1:
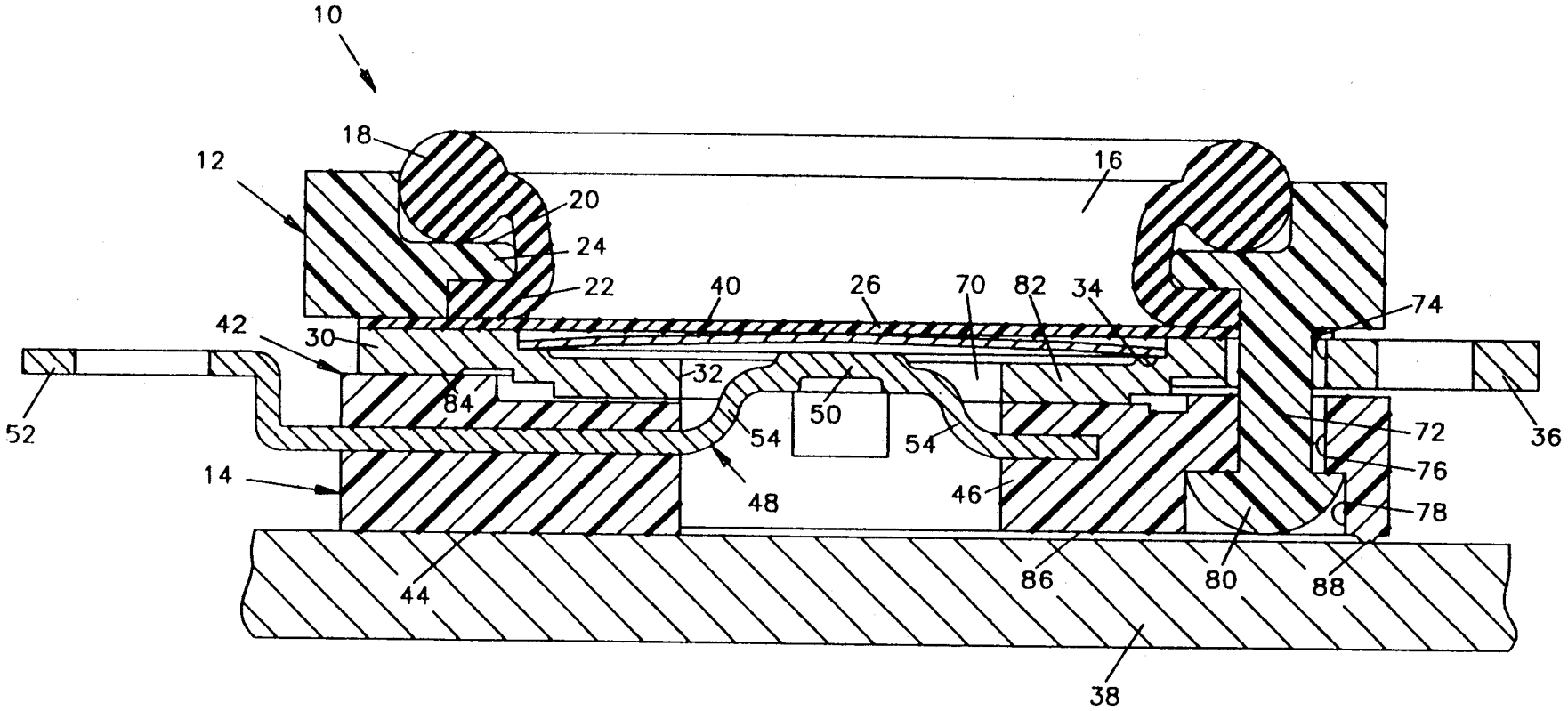
FIG. 1 is a cross sectional view of a switch made in accordance with the invention taken through line 1—1 of FIG. 4 except for combination terminal and disc seat member 30 which is taken on line 1—1' of FIG. 4 and with a portion of mounting bracket 38 also being shown in cross section.

Turning now to the drawings, numeral 10 refers to a pressure responsive switch and a mounting bracket used to mount the switch on the wall of a transmission housing (not shown), or more specifically a control valve body of a transmission system, so that a pressure responsive disc is in pressure receiving communication with the hydraulic fluid in a control line of the transmission. The switch comprises first and second housing members 12 and 14 respectfully formed of suitable electrically insulative material such as a moldable plastic. Housing member 12 is formed with a fluid receiving opening 16 and has a flexible annular O-ring type seal member 18 received on an O-ring seat 20 formed in housing member 12 around opening 16. Seal member 18 is shown having a neck and flange portion 22 which is captured under shelf 24 to lock seal member 18 in place. A seal member of this type is shown and described in U.S. Pat. No. 5,015,808, assigned to the assignee of the present invention, to which reference may be had for further details. It should be realized, however, that other suitable sealing means can be used if so desired.

A fluid sealing membrane 26 of Kapton or other suitable material is placed between the lower surface 28 of housing member 12 and an electrically conductive terminal member 30. Terminal member 30 has a centrally located aperture 32 and a disc receiving seat 34. Terminal member 30 extends laterally away from the housing members in a first direction to form a terminal connection point 36 with electrical circuit means, as in a lead frame assembly (not shown) mounted on bracket 38. An electrically conductive, pressure responsive snap acting disc 40, of stainless steel or other suitable material, is disposed on seat 34 with its at rest convex surface facing upwardly. Disc 40, when subjected to a preselected pressure level through membrane 26 will snap to an opposite concave surface configuration (not shown) as will be described in further detail below.

Second housing member 14, having upper and a lower surface portions 42 and 44, respectively is formed with a cavity 46 with an electrically conductive stationary contact member 48 extending into the cavity. Contact member 48 has a contact portion 50 disposed within aperture 32 of terminal and disc seat member 30 and is spaced a selected distance below the central portion of the at rest disc 40 so that when the disc snaps to its concave configuration it will electrically connect terminal 30 with stationary contact member 48. Contact member 48 is preferably insert molded in housing member 14 and has a terminal connection point 52 extending laterally in a second direction, opposite the first direction for connection with the electrical circuit means referenced above. Contact portion 50 has a plurality of fingers 54 emanating therefrom into the wall of housing member 14 to securely support contact portion 50 while at the same time permitting calibration by bending the legs 54 until central portion 50 is positioned in its selected position.

Figure 2:
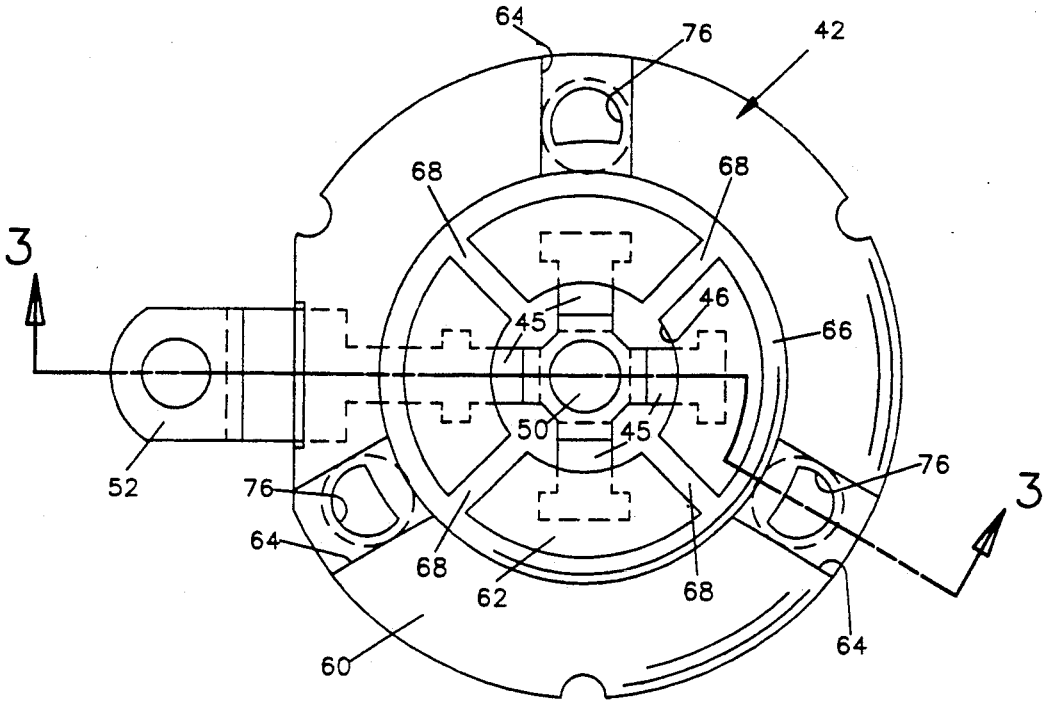
FIG. 2 is a top plan view of the bottom housing member of the FIG. 1 switch.

Top surface 42 of housing member 14, as seen in FIG. 2, is generally circular in top plan view and has a first generally annular bearing surface portion 60 adjacent the outer periphery of the housing member and a second, generally annular bearing surface portion 62 adjacent cavity 46. A vent path is formed by first channels 64 spaced around the bearing surface portion 60 and extending radially between the outer and inner peripheries thereof and into communication with a circular groove 66. Second channels 68 are formed spaced around second bearing surface portion 62 and extending radially between the outer and inner peripheries thereof and are angularly offset from channels 64 to provide a tortuous path from outside switch 10 into the switching chamber 70 defined by aperture 32, cavity 46 and disc 40.

Figure 3:
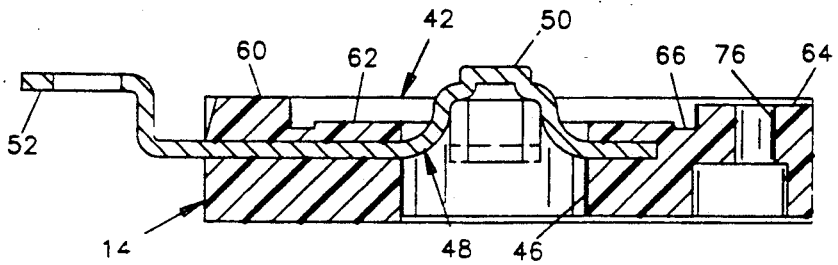
FIG. 3 is a cross sectional view of the FIG. 2 housing member.
Figure 4:
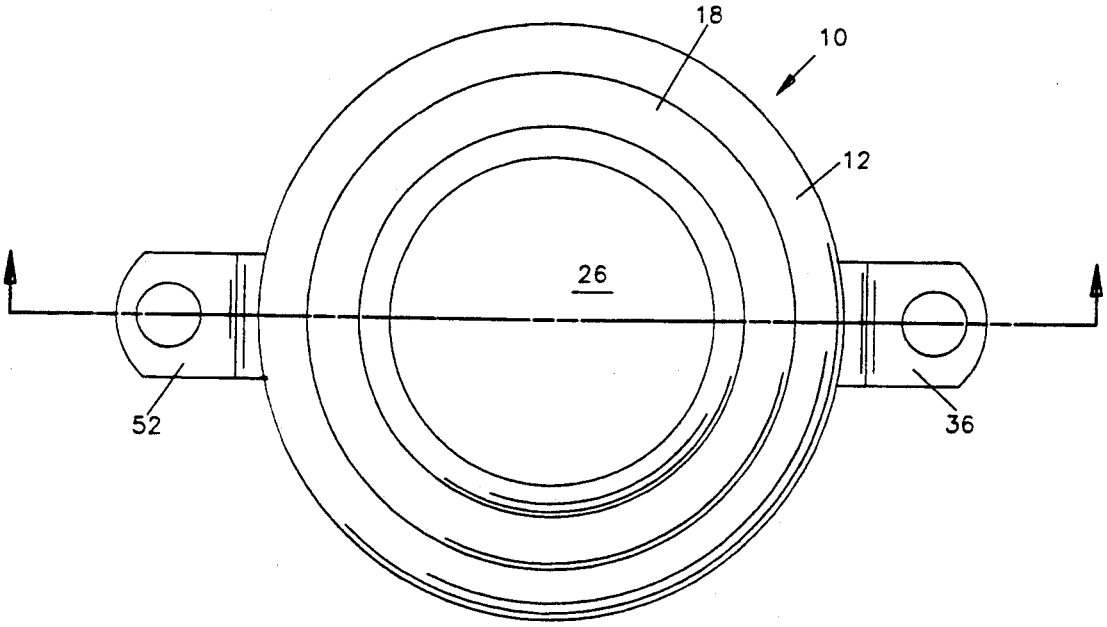
FIG. 4 is a top plan view of the switch of FIG. 1.

Housing member 12 has three post members 72 (one of which is shown in FIG. 1) which extend downwardly and are received through respective apertures 74 of terminal member 30 and bores 76 of housing member 14. Bores 76 are enlarged at 78 so that post members 72 can be deformed as indicated at 80 without extending below lower surface 44 to lock the housing members together sandwiching membrane 26 and terminal member 30 therebetween. Bores 76, as best in FIGS. 2 and 3, are aligned with respective first channels 64 so that post members 72 serve as an obstruction to limit or reduce the number and size of particles contained in the hydraulic fluid from passing through the venting path. First bearing surface portion 60 lies in a first plane and second bearing surface portion 62 lies in a second plane parallel to the first plane and spaced downwardly therefrom a selected distance. Groove 66 and channels 68 are preferably formed with a bottom surface lying in the same plane. Second channels 68 each have a selected cross sectional area of approximately $0.025 \times 0.004$ inch nominal cross section.

The lower surface 82 of the central portion of the terminal member/disc seat 30 is spaced vertically from the lower surface 84 of the outer peripheral portion of terminal member/disc seat 30 a distance selected to ensure that, when the parts are clamped together, surface 82 is tightly engaged with second bearing surface portion 62 to ensure that fluid flowing into the switch chamber is restricted to channels 68. More specifically, bearing surface portion 62 is 0.013-/0.016 inches below the first, annular bearing surface 60 while the bottom surface 82 of the member 30, contiguous to opening 32, is 0.0155 inches below the outer peripheral surface 84 overlying the first annular bearing surface 60.

Lower surface 44 of housing member 14 has a recessed portion 86 which can be used as a vent path in certain environments but in the preferred embodiment of the invention a seal ring 88 is provided circumscribing recessed area 86 so that when placed adjacent bracket 38 fluid is prevented from entering switching chamber 70 via recessed area 86 and is restricted to a path through the first and second channels 64 and 68. Thus, particles being carried along with the fluid must work their way laterally between post 72 and the sidewalls of channel 64. Any such particles then drop down into groove 66 and must travel along the groove and again change direction into channel 68 and move laterally in order to enter recess 45. Due to this tortuous path, fewer of the longer splint like particles are able to get to the switch chamber.

In the intended application switch 10 is held against a port in the wall of a control valve body (not shown) by bracket 38 in a splash area within an oil pan. In various attitudes of the vehicle the switch may fully or partially be immersed in hydraulic fluid. Debris, such as chips from the transmission gears, tend to accumulate on bracket 38 around switch 10; however, fluid entering the switching chamber 70, as stated above, can only enter the switch chamber through channels 64 disposed above the bracket and is required to travel through the tortuous path in order to reach the chamber. Thus, in accordance with the invention, the exclusion of large particles which could create an unintended current path between the disc and the stationary contact is enhanced. As mentioned above, this is particularly important in normally open switches in which debris getting into the switch chamber could get between stationary contact portion 50 and disc 40, which may have a normal contact gap on the order of 0.012 inches so that large particles could cause an unintended current path between the disc and the stationary contact portion falsely indicating that pressure in the hydraulic control line communicating with the port has increased signifying actuation of a function when in fact actuation had not occurred. The vent path of the instant invention significantly reduces the likelihood of this happening by restricting the large particles from advancing through the vent path.

As various changes could be made in the above described invention without departing from the scope of the invention, it is intended that all matter contained in the above description as well as shown in the accompanying drawings shall be interpreted as illustrative and not in a limiting sense.

We claim:

1. A pressure responsive switch for use with hydraulic fluid of automotive transmission systems comprising first and second housing members connected to one another and being formed of electrically insulative material and an electrically conductive terminal member disposed between the first and second housing members, the terminal member formed with an opening therethrough and having a disc seat, an electrically conductive disc movable between concave and convex shaped configurations disposed on the disc seat, the first housing member having an hydraulic fluid receiving opening, the opening being in pressure communication with the disc, the second housing member being generally circular in a top plan view and having an upper and lower surface, a first, generally annular bearing surface formed on the top surface adjacent the outer periphery thereof and lying in a first plane, a cavity formed in the upper surface centrally located therein, a second, generally annular bearing surface formed on the top surface adjacent the cavity, the second, annular bearing surface lying in a second plane parallel to the first plane and spaced a selected distance below the first plane, an electrically conductive stationary contact member mounted in the second housing and extending into the cavity, the disc adapted to move into and out of engagement with the stationary contact member, the cavity, the opening in the terminal member and the disc forming a switching chamber, a vent path to permit controlled flow of hydraulic fluid into the switching chamber comprising a first channel means formed in the first, annular bearing surface from the outer periphery to the inner periphery thereof, a circular groove having a bottom surface disposed below the second plane and being in communication with the first channel means, and a second channel means in communication with the circular groove formed in the second, annular bearing surface from the outer periphery to the inner periphery thereof and being in communication with the switching chamber, the second channel means being angularly offset from the first channel means whereby any particles contained in the hydraulic fluid flowing into the switching chamber are restricted to a tortuous path comprising lateral movement in the first channel means, downward movement into the groove, circular movement in the groove and then lateral movement in the second channel means before arriving at the switching chamber, the tortuous path serving to reduce the size and quantity of particles reaching the switching chamber.

2. A pressure responsive switch according to claim 1 in which the first channel means comprises a plurality of radially extending channels spaced around the first annular bearing surface.

3. A pressure responsive switch according to claim 1 in which the second channel means comprises a plurality of radially extending channels spaced around the second annular bearing surface.

4. A pressure responsive switch according to claim 1 in which a plurality of spaced posts extend from one housing toward the other housing, the other housing having a plurality of post receiving apertures aligned with the respective posts, the posts received in respective post receiving apertures and having a distal end portion deformed to lock the housing members together, the post receiving apertures being located in the first channel means whereby the posts received in the apertures restrict the space in the channel means through which debris must pass to get to the switching chamber.

5. A pressure responsive switch according to claim 1 in which the second channel means comprises a plurality of radially extending channels spaced around the second annular bearing surface, each channel of the second channel means having a nominal cross section of approximately $0.025 \times 0.004$ inches.

6. A pressure responsive switch according to claim 1 further including a mounting bracket received over the switch and being adapted to attach the switch to a transmission housing, the centrally located cavity in the second housing member extending to the lower surface with the bracket extending over the centrally located recess and means to prevent flow of fluid from outside of the switch along a path between the bracket and the switch into the switching chamber.

7. A pressure responsive switch for use with hydraulic fluid of automotive transmission systems comprising first and second housing members connected to one another and being formed of electrically insulative material and movable electrically conductive means disposed between the first and second housing members, the first housing member having an hydraulic fluid receiving opening, the opening being sealed from and in pressure communication with the movable electrically conductive means, the second housing member having an upper and lower surface, a first bearing surface formed on the top surface having an inner and an outer periphery and lying in a first plane, a cavity formed in the upper surface within the first bearing surface, a second bearing surface formed in the top surface adjacent the cavity, the second bearing surface having an inner and an outer periphery lying in a second plane parallel to the first plane and spaced a selected distance below the first plane, an electrically conductive stationary contact member mounted in the second housing and extending into the cavity, the movable electrically conductive means movable into and out of engagement with the stationary contact means in dependence on the level of pressure of hydraulic fluid received in the hydraulic fluid receiving opening, a vent path to permit controlled flow of hydraulic fluid into the cavity comprising a first channel means formed in the first cavity bearing surface from the outer periphery to the inner periphery thereof, a second channel means formed in the second bearing surface from the outer periphery to the inner periphery thereof and being in communication with the cavity, a groove formed in the upper surface of the second housing member extending below the second plane and communicating with the first and second channel means whereby fluid can flow from outside the switch into the first channel means, then into the groove and then through the second channel means into the cavity.

8. A pressure responsive switch for use with hydraulic fluid of automotive transmission systems comprising first and second housing members connected to one another and being formed of electrically insulative material and an electrically conductive terminal member disposed between the first and second housing members, the terminal member formed with an opening therethrough and having a disc seat, an electrically conductive disc movable between concave and convex shaped configurations disposed on the disc seat, the first housing member having a hydraulic fluid receiving opening, the opening being in pressure communication with the disc, the second housing member being generally circular in a top plan view and having an upper and lower surface, a first, generally annular bearing surface formed on the top surface adjacent the outer periphery thereof and lying in a first plane, a cavity formed in the upper surface centrally located therein, a second, generally annular bearing surface formed on the top surface adjacent the cavity, the second annular bearing surface lying in a second plane parallel to the first plane and spaced a selected distance below the first plane, an electrically conductive stationary contact member mounted in the second housing and extending into the cavity, the disc adapted to move into and out of engagement with the stationary contact member, the cavity, the opening in the terminal member, and the disc forming a switching chamber, a vent path to permit controlled flow of hydraulic fluid into the switching chamber comprising a first channel means formed in the first, annular bearing surface from the outer periphery to the inner periphery thereof, a circular groove having a bottom surface disposed below the second plane and being in communication with the first channel means, and a second channel means in communication with the circular groove formed in the second annular bearing surface from the outer periphery to the inner periphery thereof and being in communication with the switching chamber.

9. A pressure responsive switch according to claim 8 in which the first and second channel means are offset from one another.

* * * * *